US005770992A

United States Patent [19]

Waters

[11] Patent Number: 5,770,992

[45] Date of Patent: Jun. 23, 1998

[54] TRANSFORMER WITH OVERSHOOT COMPENSATION COIL

[75] Inventor: Christopher A. Waters, Redwood City, Calif.

[73] Assignee: Pearson Electronics, Inc., Palo Alto, Calif.

[21] Appl. No.: 255,054

[22] Filed: Jun. 7, 1994

[51] Int. Cl.[6] ..... H01F 27/36; H01F 21/08

[52] U.S. Cl. ..... 336/84 R; 336/155

[58] Field of Search ..... 336/155, 84 R

[56] References Cited

U.S. PATENT DOCUMENTS

| | | | |
|---|---|---|---|
| 3,146,417 | 8/1964 | Pearson | 336/64 |
| 4,166,992 | 9/1979 | Brueckner et al. | 336/155 |

*Primary Examiner*—J. R. Scott
*Assistant Examiner*—Daniel Chapik
*Attorney, Agent, or Firm*—Flehr Hohbach Test Albritton & Herbert

[57] ABSTRACT

A transformer that comprises a winding assembly, a first and a second output terminal and a first and a second conductive path. The winding assembly includes a first and a second winding assembly terminal, a winding coupled between the first and second winding assembly terminals, and a resistive load coupled between the first and second winding assembly terminals. The resistive load has a resistance and an intrinsic inductance effectively in series with the resistance. The first conductive path connects the first winding assembly terminal and the first output terminal. The second conductive path connects the second winding assembly terminal and the second output terminal. The first and second conductive paths enclose an area through which magnetic flux can pass so as to provide a pickup loop inductance between the first and second output terminals. The first conductive path includes a compensation coil having a compensation inductance sufficient to reduce output overshoot at the first and second output terminals caused by the intrinsic inductance and the pickup loop inductance.

12 Claims, 6 Drawing Sheets

TRANSFORMER WITH OVERSHOOT COMPENSATION COIL

The present invention relates generally to transformers. Specifically, it relates to a transformer for monitoring pulse and/or alternating currents which has an overshoot compensation coil for offsetting and reducing output overshoot across the output terminals of the transformer.

BACKGROUND OF THE INVENTION

In the prior art current monitoring transformers, the useable rise-time of the output signal of the transformer is typically large. For example, in the case of a transformer with a 2 inch hole diameter, this rise time is at best approximately 20 nanoseconds. Thus, the prior art transformers cannot accurately monitor current pulses of shorter rise-time than 20 nanoseconds or alternating currents with frequencies above 20 megahertz.

The reason that the useable rise-time of the output signal of these transformers is rather large is that significant output signal overshoot (i.e., the maximum positive value of the output signal minus the final output signal value) and ringing in the output signal (i.e., oscillation in the output signal) typically occurs. In the case of a transformer with a 2 inch hole diameter, overshoot of approximately 10% is typical while ringing amplitude of approximately 5% is typical when viewing a current pulse with 20 nanosecond rise-time. This is due to several factors.

First, some prior art transformers, such as the one described in expired U.S. Pat. No. 3,146,417, which is hereby expressly incorporated by reference, have a winding assembly that includes a winding, a terminating resistive load, and a terminating planar conductor both formed along the length of the core. Taps connect the winding and the resistive load at roughly equidistant points on the winding so that the resistive load is distributed.

Since the resistive load traverses the length of the core, it has a rather large intrinsic inductance (or inductance per unit length). The taps of the resistive load distribute the intrinsic inductance among the small transformer sections. Thus, a voltage can be induced across each of the distributed intrinsic inductances which can result in large output signal overshoot across the output terminals of the transformer.

Second, the prior art transformers include a shield where the edges of the end portions of the shield that form a gap in the shield do not overlap. As a result, current in the conductor or circuit being monitored which does not flow perpendicular to the sides of the transformer may result in magnetic flux within the shield that penetrates through the gap. This type of magnetic flux is noncircumferential within the transformer shield and is therefore considered stray magnetic flux.

The non-circumferential stray magnetic flux is undesirable since the conductive paths that connect the winding assembly to the output terminals partially enclose and define a loop pickup area through which magnetic flux can pass. Thus, when a rapid change in stray noncircumferential magnetic flux that passes through the loop pickup area occurs, a voltage spike is induced due to the mutual inductance of the pickup loop with the conductor or circuit being monitored. This voltage spike is seen as output signal overshoot across the output terminals of the transformer.

Third, the conductive paths of the prior art transformers may include the widely spaced apart inner and outer conductors of a large gauge flexible coaxial cable, lengthy, widely spaced apart, and unshielded conductive elements including wires and resistors, and any combination thereof. Thus, the loop pickup area that the conductive paths enclose is large. As a result, a significant voltage spike across the output terminals of the transformer will be induced when a rapidly changing magnetic flux passes through this loop pickup area thereby also resulting in output signal overshoot across the output terminals of the transformer.

Fourth, in the prior art transformers, the transformer shield is adjacent the winding assembly in order to make the transformer as compact as possible. However, this results in large capacitances being developed between the transformer shield and the core, winding, resistive load, and/or planar conductor of the winding assembly. These capacitances affect the performance of the transformer in that they cause significant ringing of the output signal (i.e., oscillation) of the transformer in response to fast-rising pulses in the current being monitored by the transformer.

SUMMARY OF THE INVENTION

The foregoing problems are cured by a transformer that comprises a winding assembly that includes a first and a second winding assembly terminal, a winding coupled between the first and second winding assembly terminals, and a resistive load coupled between the first and second winding assembly terminals. The resistive load has a resistance and an intrinsic inductance effectively in series with the resistance.

The transformer also includes a first conductive path that connects the first winding assembly terminal and the first output terminal and a second conductive path that connects the second winding assembly terminal and the second output terminal. The first and second conductive paths at least partially enclose a loop pickup area through which magnetic flux can pass so as to provide an associated pickup loop inductance between the first and second output terminals.

The first conductive path includes a compensation coil having a compensating mutual inductance with the conductor or circuit being tested sufficient to reduce output overshoot at the first and second output terminals caused by the intrinsic inductance and the pickup loop inductance.

In addition, the transformer comprises a transformer shield that encloses the winding assembly but does not enclose another transformer shield. The transformer shield has end portions that overlap but do not contact each other so as to define an elongated gap. Moreover, all of the transformer shield is spaced from the winding assembly.

BRIEF DESCRIPTION OF THE DRAWINGS

The invention will be more readily apparent from the following detailed description and appended claims when taken in conjunction with the drawings, in which:

DETAILED DESCRIPTION OF THE INVENTION

Figure 1:
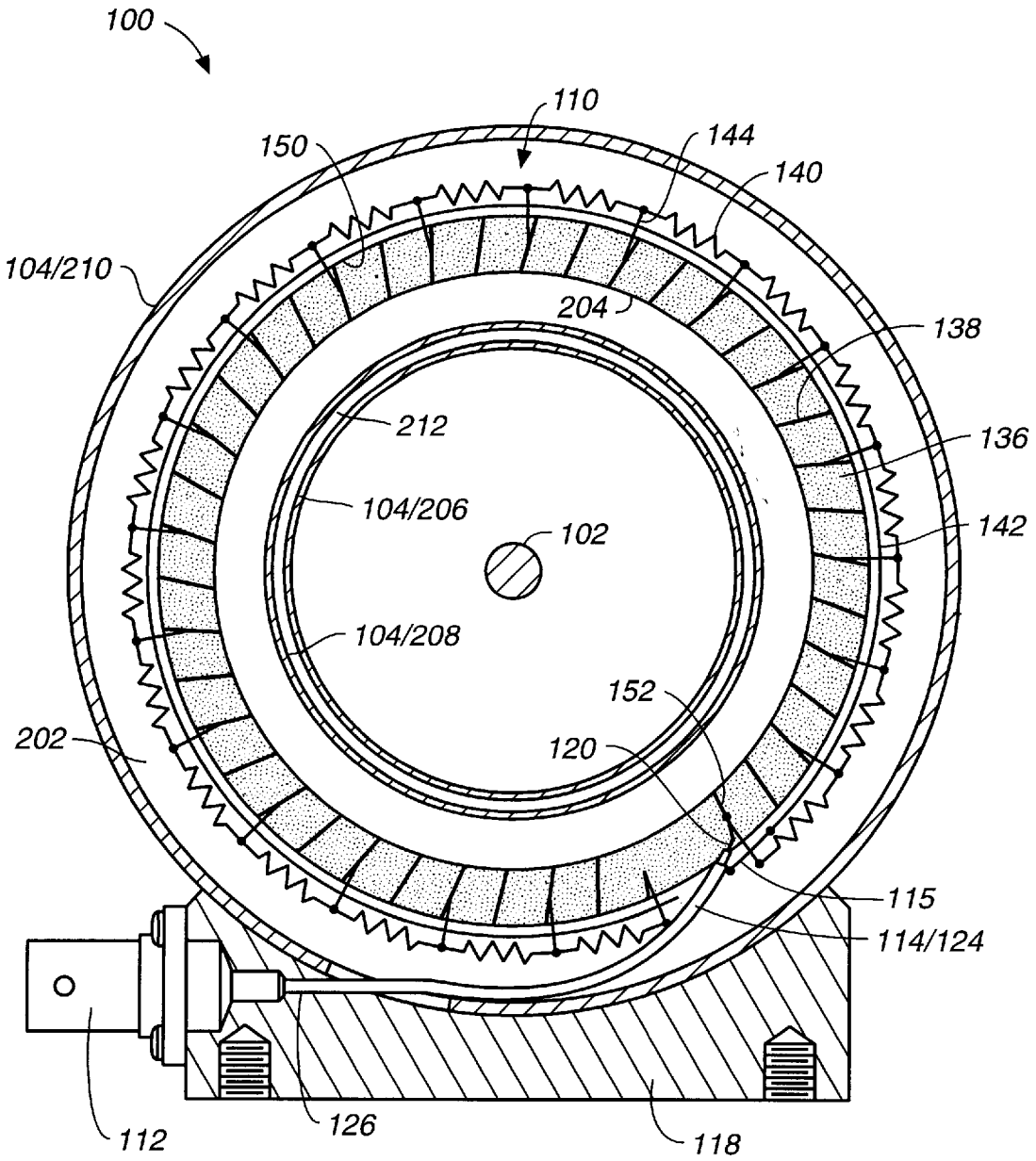
FIG. 1 shows a transformer in accordance with the present invention.

Referring to FIG. 1, there is shown a schematic view of a transformer 100 for monitoring pulse and/or alternating currents in a conductor 102. As is known by those skilled in the art, a change in the current of the conductor 102 results in a changing magnetic flux within the transformer shield 104. In response, a voltage is induced across the terminals 106 and 108 of the winding assembly 110 which is generally proportional to and generally has the same frequency and phase as the current of the conductor 102. This voltage is supplied to the coaxial connector 112 by the coaxial cable 114 and is output by the coaxial connector 112 as the output signal of the transformer 100.

Figure 3:
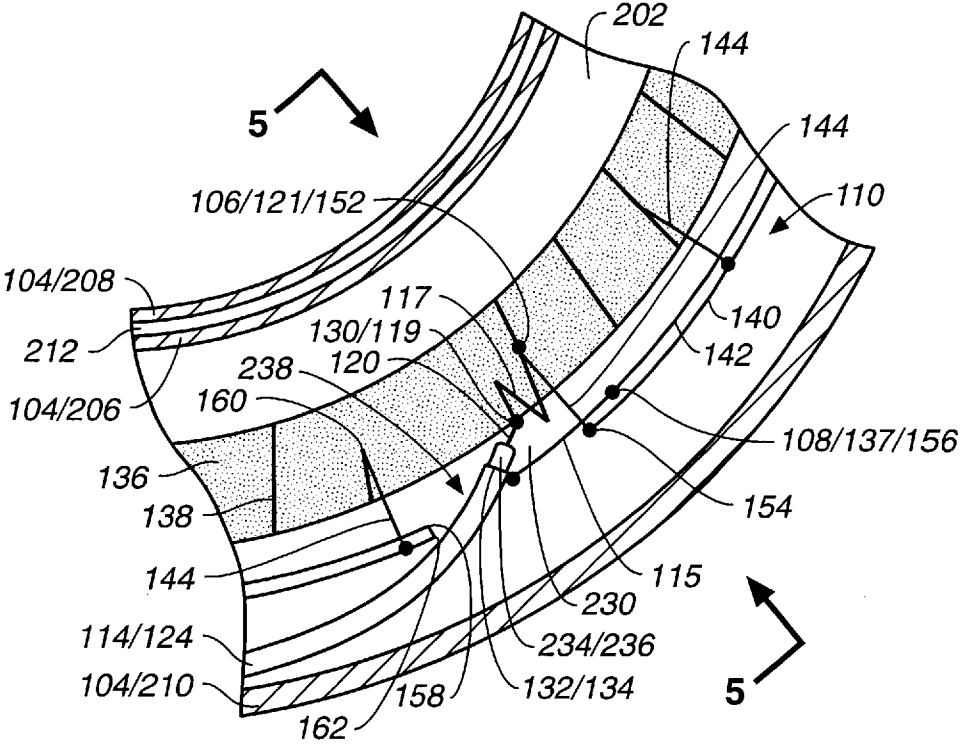
FIG. 3 is a close up view of the winding assembly terminal area of the transformer of FIG. 1.

As shown in FIG. 1, transformer 100 includes the winding assembly 110, the coaxial cable 114, the conductive wire 115, the coaxial connector 112, the torrid shaped transformer shield 104, and a support base 118. Moreover, as shown in FIG. 3, transformer 100 includes an overshoot compensation coil 117. The compensation coil 117 is not shown in FIG. 1 for purposes of clarity.

The support base 118 of transformer 100 is fixed to the transformer shield 104. The coaxial connector 112 is fixed to the support base 118 and connected to the coaxial cable 114 within the support base 118. The coaxial cable 114 runs through the support base 118 and into the transformer shield 104.

Figure 2:
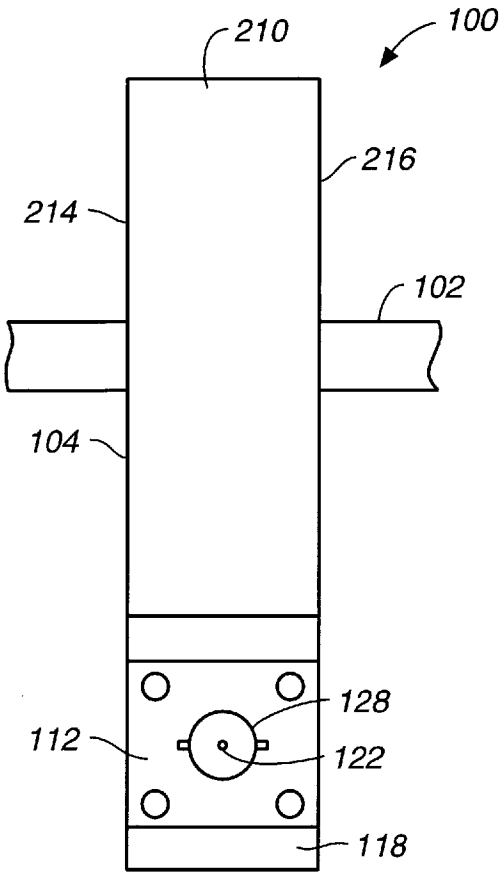
FIG. 2 provides an exterior front view of the transformer of FIG. 1.

Referring to both FIGS. 1 and 2, the end of the inner conductor 120 of the coaxial cable 114 which is not shown is connected to the output signal terminal (i.e., inner connector member) 122 of the coaxial connector 112. The end 126 of the outer conductor 124 of the coaxial cable 114 is connected to the output return terminal (i.e., outer connector body) 128 of the coaxial connector 112.

Referring to FIGS. 1 and 3, the unshielded end 130 of the inner conductor 120 (which is not surrounded by the outer conductor 124 of the coaxial cable 114) is connected to the first end 119 of the compensation coil 117 while the second end 121 of the compensation coil 117 is connected to the signal terminal 106 of the winding assembly 110. The end 132 of the outer conductor 124 is connected to the first end 134 of the conductive wire 115. The second end 136 of the conductive wire 115 is connected to the return terminal 108 of the winding assembly 110.

Thus, the inner conductor 120 and the compensation coil 117 together serve as a conductive output signal path that connects the output signal terminal 122 of the transformer 100 and the signal terminal 106 of the winding assembly 110. And, the outer conductor 124 and the conductive wire 115 together serve as a conductive return signal path that connects the output return terminal 128 of the transformer 100 and the return terminal 108 of the winding assembly 110.

The winding assembly 110 includes a toroid shaped core 136, a mostly toroid shaped winding 138, a terminating resistive load 140, a terminating planar conductor 142, a number of resistive taps 144, and the terminals 106 and 108. Formed over substantially most of the core 136 is the winding 138 and formed along substantially most of the outer circumference or length 150 of the core 136 are the resistive load 140, and the planar conductor 142. The winding 138 and resistive load 140 are connected by the resistive taps 144 at various points along the outer circumference 150 of the core 136.

Referring again to FIGS. 1 and 3, the signal terminal 106 of the winding assembly 110 is connected to the first end 152 of the winding 138 and the first end 154 of the resistive load 140. The return terminal 108 of the winding assembly 110 is connected to the first end 156 of the planar conductor 142. The second end 158 of the planar conductor 142 is connected to the second end 160 of the winding 138 and the second end 162 of the resistive load 140.

Figure 4:
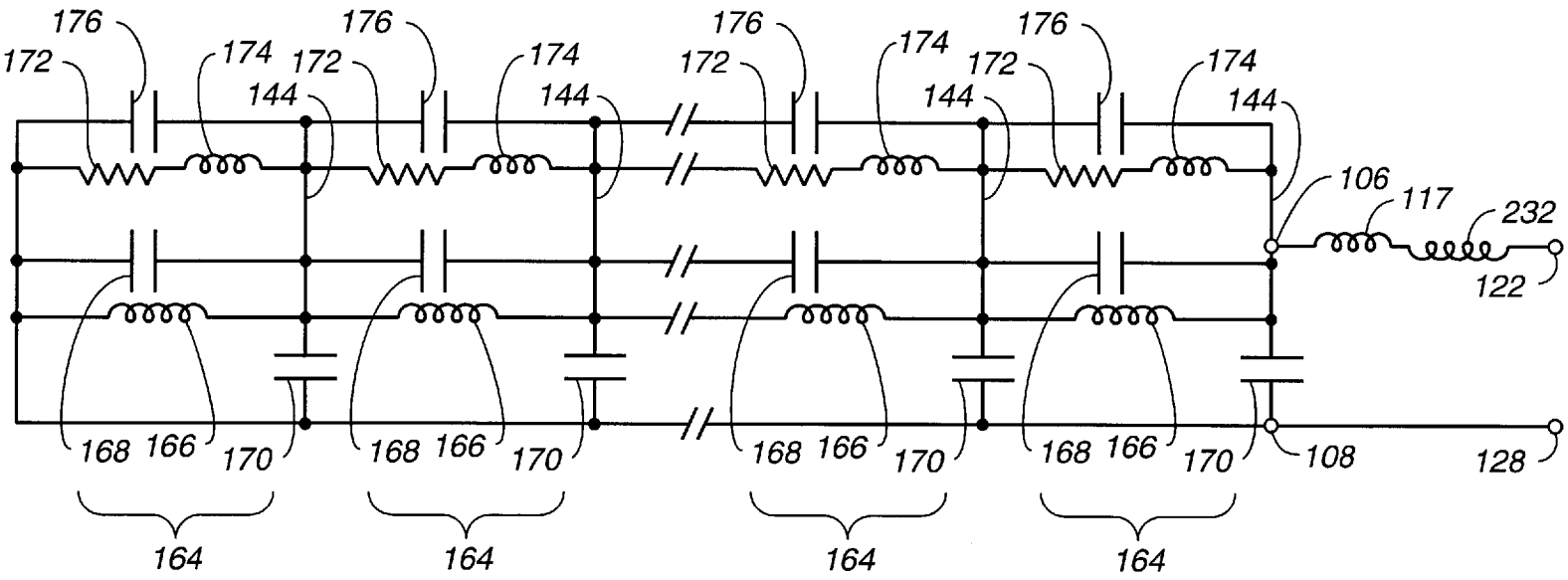
FIG. 4 provides an equivalent circuit for the transformer of FIG. 1.

As described in expired U.S. Pat. No. 3,146,417, the foregoing construction of transformer 100 makes the resistive load 140 distributed. As shown in FIG. 4, the resulting equivalent circuit for transformer 100 comprises a number of serially connected small transformer sections 164 located between each tap 144.

Each of the small transformer sections 164 includes a transformer section inductance 166. The transformer section inductances 166 are the distributed inductances between the taps 144 which are due to the winding 138.

Each of the small transformer sections 164 also includes the transformer section capacitances 168 and 170. The transformer section capacitance 168 is the capacitance from the electric coupling between the turns of the winding 138 in the transformer section 164 (i.e., the capacitance between two taps 144). The transformer section capacitance 170 is the capacitance from the electric coupling of the winding 138 and the resistive load 140 to the core 136, the transformer shield 104, and the planar conductor 142.

Each of the small transformer sections 164 further includes a transformer section resistance 172. The transformer section resistances 172 are the distributed portions of the resistive load 142 between each tap 144.

Furthermore, since the resistive load 140 traverses along approximately the outer circumference 150 of core 136, it has an intrinsic inductance and an intrinsic capacitance associated with it. Although the intrinsic inductance is reduced by use of the planar conductor 142 (in that the resistive load 140 and planar conductor 142 together comprise a transmission line) a significant amount of the intrinsic inductance still remains which affects performance of the transformer 100, as will be discussed shortly.

Thus, associated with each of the transformer section resistances 172 is a transformer section intrinsic inductance 174 and a transformer section intrinsic capacitance 176. The transformer section intrinsic inductance 174 is effectively connected in series with the transformer section resistance 170 and the transformer intrinsic capacitance 176 is effectively connected in parallel with the series connection of the transformer section resistance 170 and transformer section intrinsic inductance 174. Therefore, in response to a rapid change in the current of conductor 102, such as the fast-rising edge of a pulse signal, a voltage spike is induced across each of the transformer section intrinsic inductances 174 which results in output signal overshoot across the output terminals 122 and 128 of the transformer 100. As will be described later, this output signal overshoot is reduced by adding the compensation coil 117 to transformer 100.

Figure 5:
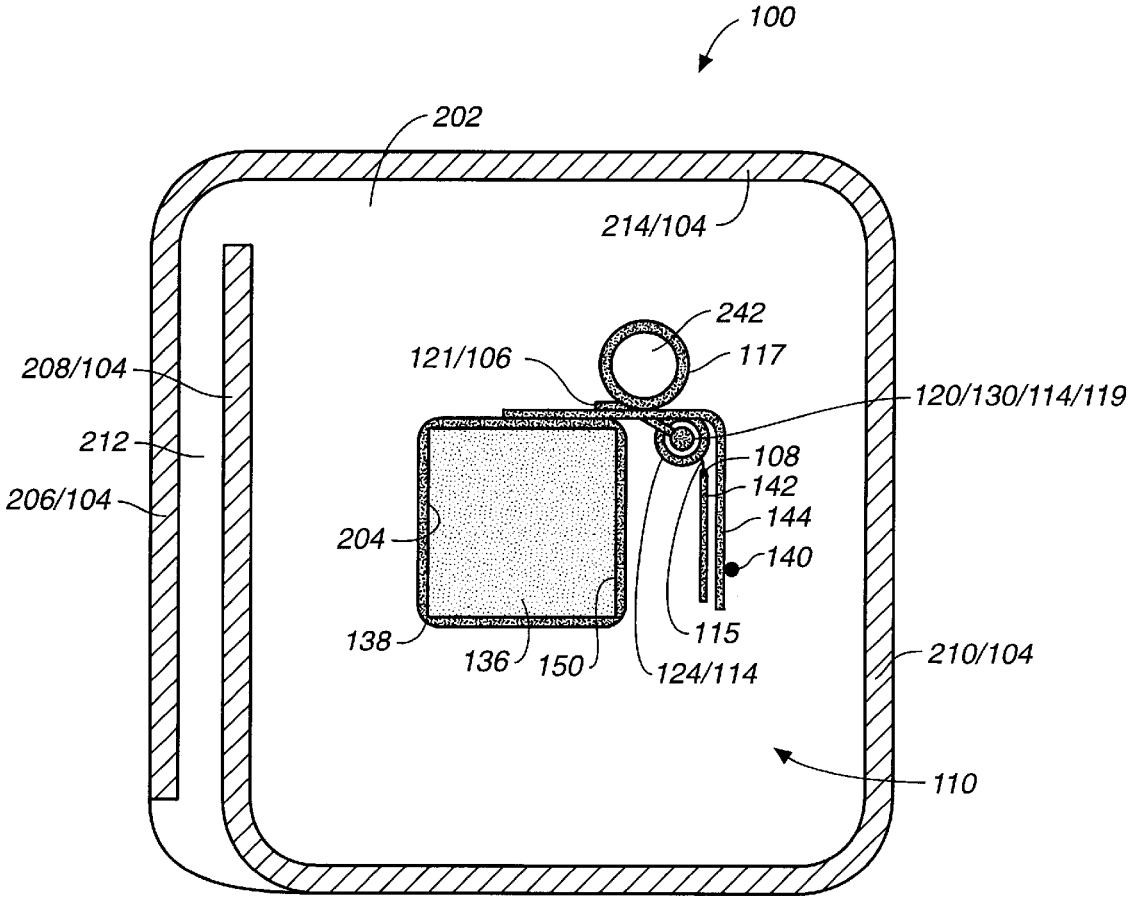
FIG. 5 provides a cross sectional view of the transformer of FIGS. 1 and 3 taken along the line 5—5 of FIG. 3.

FIG. 5 shows a cross sectional view of the transformer 100. This cross sectional view is in the area shown by FIG. 3.

Around the magnetic core 136 is formed the winding 138. Spaced from and traveling substantially most of the outer circumference 150 of the core 136 are the planar conductor 142 and the resistive load wire 140. The resistive load wire 140 is adjacent to and travels parallel to the planar conductor 142. The tap 144 connects the resistive load wire 140 to the winding 138. The epoxy filler or dielectric material 202 fills the spaces of the winding assembly 110. This construction of the winding assembly 110 is similar to that described in expired U.S. Pat. No. 3,146,417, except that in the present invention, as shown in FIG. 1, the planar conductor 142 and the resistive load 140 are formed along substantially most of the outer circumference 150 of the core 136 rather than its inner circumference 204.

In the preferred embodiment, the core 136 has a cross section of approximately 0.25 inches by 0.25 inches and the outer and inner circumferences 150 and 204 of the core 136 are approximately 10.2 inches and 8.6 inches. Moreover, the planar conductor 142 and the resistive load wire 140 are spaced approximately 0.12 inches from the outer circumference 150 of the core 136. The resistive load 140 has a resistance of approximately 50 ohms and the winding 138 has approximately 500 turns.

The compensation coil 117 lies above the winding assembly 110. As will be described later, the compensation coil 117 is oriented so that the loop area enclosed by each of its turns is substantially perpendicular to circumferential magnetic flux within the transformer shield 104. As was indicated earlier, the first end 119 of the compensation coil 117 is connected to the unshielded end 130 of the inner conductor 120 while the second end 121 of the compensation coil 117 is connected to the tap 144 to from the signal terminal 106 of the winding assembly 110.

The transformer shield 104 encloses the winding assembly 110, the conductive wire 115, the resistor 178, and the capacitor 180. The remaining space within the transformer shield 104 is filled with the epoxy filler or dielectric material 202.

Transformer shield 104 includes two circumferential inner walls or portions 206 and 208, a circumferential outer wall 210, and two side walls 214 and 216. The inner walls 206 and 208 are integrally joined to the side walls 214 and 216 respectively while the side walls 214 and 216 are each joined to the outer wall 210. The two inner walls 206 and 208 overlap over a substantial length, are spaced apart, and do not contact each other so as to define an elongated or deep insulating gap 212 that is circumferential.

In the preferred embodiment, with transformer shield 104 has a cross section of approximately 1 inch by 1 inch. The inner walls 206 and 208 are spaced approximately 0.030 inches apart and overlap by approximately 0.70 inches. Thus, in the preferred embodiment the gap 212 has a width of 0.030 inches and a length of approximately 0.70 inches.

Figure 6:
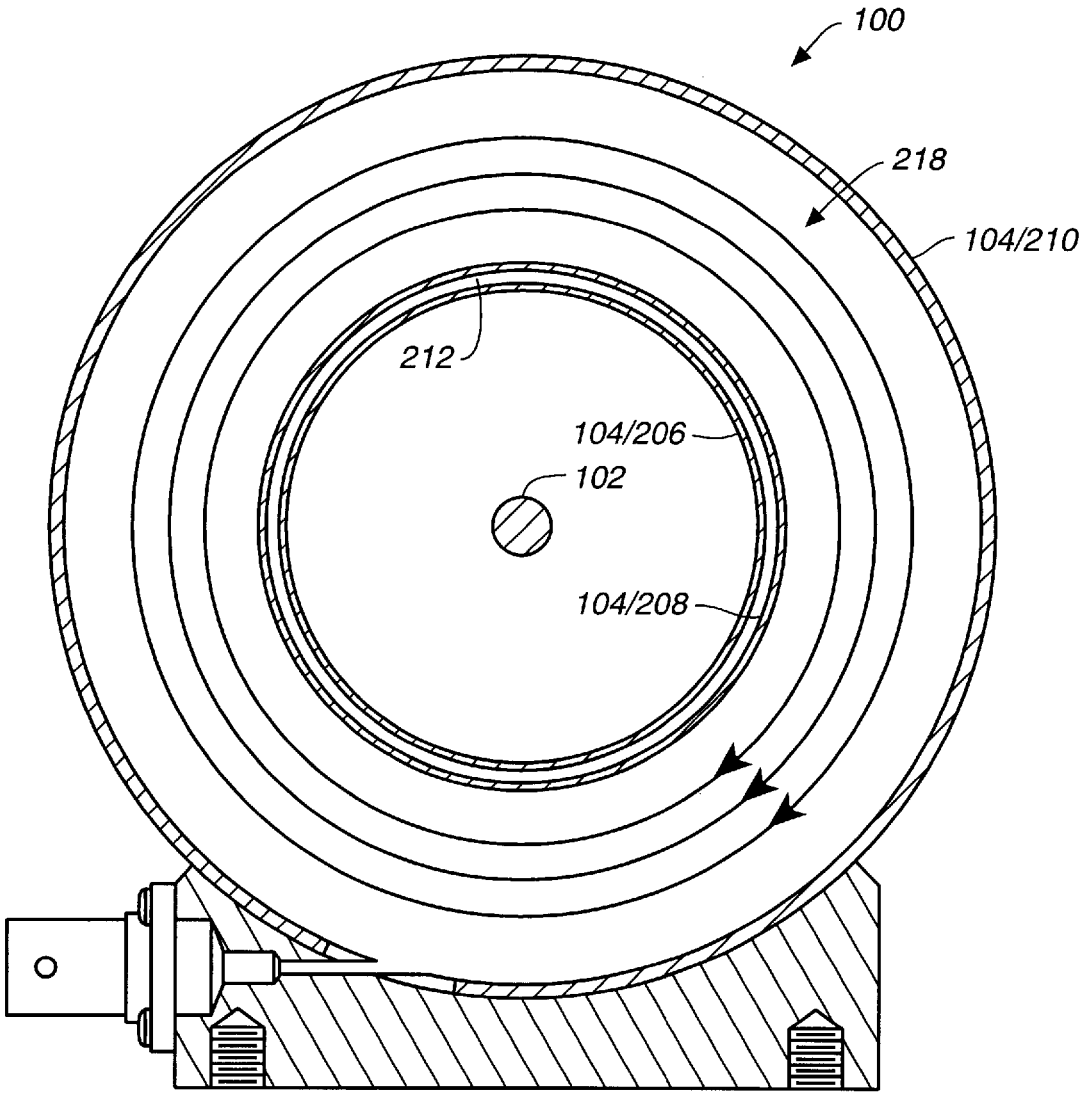
FIG. 6 shows penetration of circumferential magnetic flux within the transformer shield of the transformer of FIG. 1.

As shown in FIG. 6, the transformer shield 104 is toroid shaped to allow penetration of circumferential magnetic flux 218 within the transformer shield 104. Such circumferential magnetic flux 218 occurs at points where the current of the conductor 102 under test flows perpendicular to the side walls 214 and 216 (shown in FIG. 16) of the transformer shield 104. The gap 212 prevents the transformer shield 104 from acting as a shorted turn with currents induced by changes in the circumferential magnetic flux 218 which would create an opposing magnetic flux that would effectively cancel the circumferential magnetic flux 218.

Figure 7:
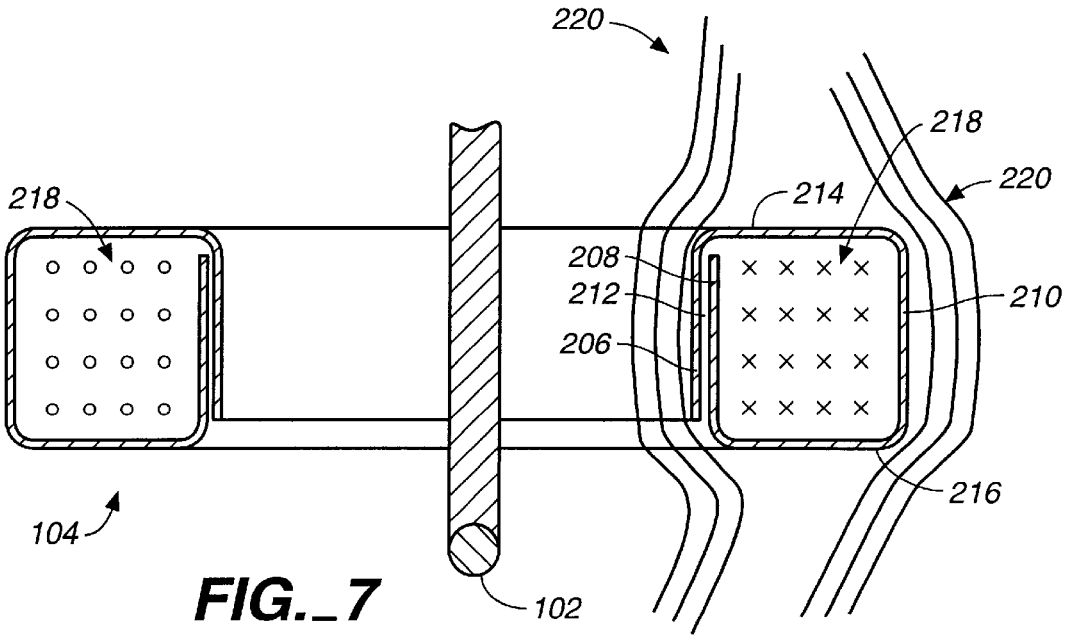
FIG. 7 shows reduction of penetration of stray magnetic flux through the elongated insulating gap of the transformer shield of FIG. 6 that is not circumferential within the transformer shield.

Moreover, as shown in FIG. 7, the elongated insulating gap 212 of transformer shield 104 reduces or insulates against penetration of stray magnetic flux 220 that is not circumferential within the transformer shield 104. Such non-circumferential stray magnetic flux 220 occurs at points where the conductor 102 under test is bent (out of the page) towards one of the side walls 214 or 216 of the transformer shield 104 and the current does not flow perpendicular to the side walls 214 and 216 of the transformer shield 104.

In this situation, circumferential currents perpendicular to the stray magnetic flux 220 are induced in the outer wall 210 and the inner walls 206 and 208 of the transformer shield 104 by changes in the stray magnetic flux 220. This creates an opposing magnetic flux within the transformer shield 104 that effectively cancels the stray magnetic flux 220. This cancellation occurs even in the elongated gap 212 since the length of the gap 212 (due to the overlapping inner walls 206 and 208) is substantially greater than its width. In other words, enough currents will be induced over the length of the gap 212 in the overlapping inner walls 206 and 208 to create an opposing magnetic flux that offsets the stray magnetic flux 220 in the gap 212.

Figure 8:
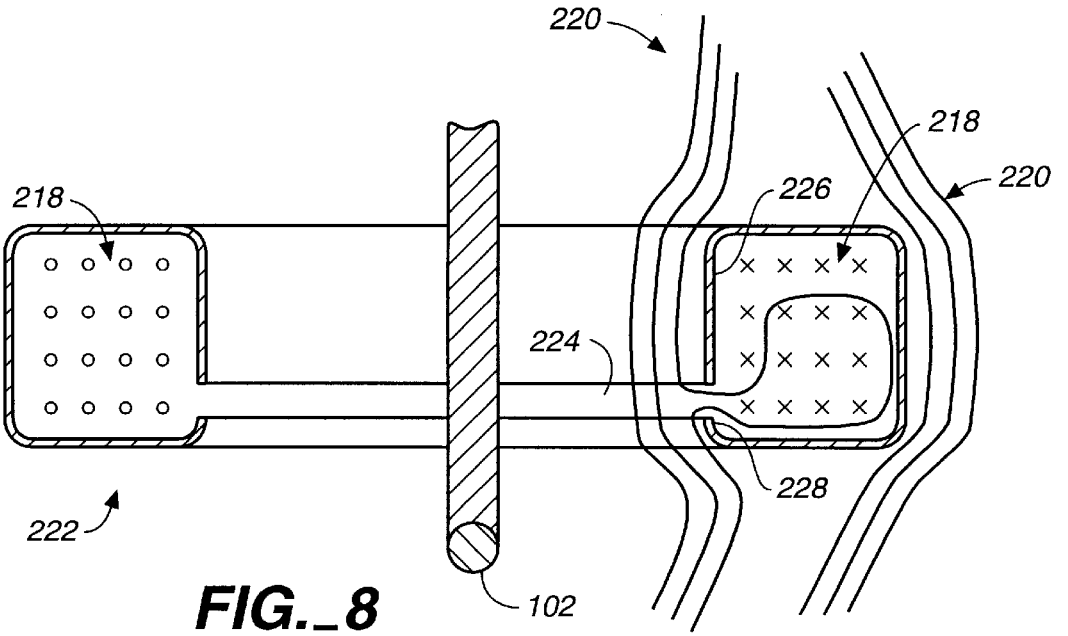
FIG. 8 (PRIOR ART)
FIG. 8 shows penetration of stray magnetic flux through the conventional non-elongated gap of a prior art transformer shield.

In contrast, FIG. 8 shows a prior art transformer shield 222 with a conventional non-elongated gap. The inner end portions or walls 226 and 228 of transformer shield 222 which define the gap 224 do not overlap. As a result, stray magnetic flux 220, due to current in the conductor 102 being monitored that does not flow perpendicular to the side walls 214 and 216 of the transformer shield 222, can penetrate through the gap 224 into the area enclosed by the transformer shield 222. This occurs because the length of the gap 224 (i.e., the thickness of end walls 226 and 228) relative to its width (i.e, the distance between end walls 226 and 228) is small. As a result, the short length of gap 224 relative to its width prevents enough currents from being induced in the end walls 226 and 228 which will create an opposing magnetic flux in the space around the gap 224 that will offset the stray magnetic flux 220 in this space.

Referring back to FIGS. 1 and 3, where the inner and outer conductors 120 and 124 of the coaxial cable 114 are respectively coupled to the compensation coil 117 and conductive wire 115, the outer conductor 124 does not surround the inner conductor 120 so that shielding of the conductive output signal path ends. Where there is no shielding of the conductive output signal path, the conductive output and return signal paths at least partially define and enclose a loop pickup area 230 through which magnetic flux can pass.

As shown in FIG. 4, the equivalent circuit includes a loop pickup area mutual inductance 232 which is effectively provided in the conductive output signal pat as the mutual inductance of the loop pickup area 230 with the conductor 102. When rapidly changing circumferential magnetic flux or stray non-circumferential magnetic flux passes through the loop pickup area 230, a voltage spike is induced across the loop pickup area mutual inductance 232. This induced voltage spike is then seen as output signal overshoot across the output terminals 122 and 128.

However, referring again to FIG. 7, since transformer shield 104 has an elongated insulating gap 212, the penetration of the stray non-circumferential magnetic flux 218 is reduced. Thus, the voltage spike induced across the loop pickup area mutual inductance 232 shown in FIG. 4 due to a rapid change in magnetic flux 218 through loop pickup area 230 is reduced which results in reduced output signal overshoot across output terminals 122 and 128.

In the case of the prior transformer shield 222 shown in FIG. 8 which has a non-elongated gap 224, the penetration of the stray non-circumferential magnetic flux 220 is rather large. Thus, if the prior art transformer shield were employed for the transformer 100 shown in FIG. 1, the voltage spike induced across the pickup loop mutual inductance 232 in FIG. 4 due to a rapid change in magnetic flux 220 through loop pickup area 230 would be large and result in significant output signal overshoot across the output terminals 122 and 128.

Although winding assembly 110 above was described as including a core 136, a winding 138, a resistive load 140, a planar conductor 142, and taps 144, the insulating gap 212 just described can be used for other types of winding assemblies. Such winding assemblies might include simply a winding and no core or might include just a winding and a core.

Moreover, one skilled in the art will recognize that the conductive output and return signal paths may include the inner and outer conductors of a flexible coaxial cable or a semi-rigid coaxial cable, conductive wires, resistors, or other types of conductive elements and any combination thereof.

However, for purposes to be described shortly, in the preferred embodiment, the conductive output and return signal paths respectively include the inner copper conductor 120 and the tubular outer copper conductor 124 of a small-gauge semi-rigid coaxial cable 114, as shown in FIGS. 1 and 3. The coaxial cable 114 includes, in addition to the inner and outer conductors 120 and 124, a tubular insulator 234 between the inner and outer conductors 120 and 124. The tubular outer conductor 124 surrounds most of the inner conductor 120 except the end 130 (including the portion covered by the exposed end 236 of the insulator 234).

As shown in FIG. 3, the winding assembly has a space 238 between the ends 154 and 162 of the resistive load 140 and between the ends 156 and 158 of the planar conductor 142. The coaxial cable 114 extends into the space 238. Because the coaxial cable 114 has a small cross sectional area, the space 238 is made small so that the resistive load 140 and the planar conductor 142 traverse substantially most of the outer circumference 150 of the core 136.

The coaxial cable 114 may have a cross sectional diameter approximately in the range of 0.040–0.085 inches. In the preferred embodiment, this diameter is approximately 0.060 inches, the space 238 is approximately 0.040 inches, and the unshielded end 130 of the inner conductor 120 is approximately 0.12 inches long.

Since the coaxial cable 114 extends into the space 238, the ends 130 and 132 of the inner and outer conductors 120 and 124 can be respectively disposed proximate to the terminals 106 and 108 of the winding assembly 110 while being respectively coupled to them as well. Thus, the end 130 of inner conductor 120 can be proximately coupled to the terminal 106 by the compensation coil 117. Moreover, the end 132 of outer conductor 124 can be directly connected to the terminal 108, or can be proximately coupled to the terminal 108 by a conductive wire, as shown in FIG. 3, or a resistor, a coil, or other conductive element or circuit. Thus, since the distance of the conductive output and return signal paths from the ends 130 and 132 of the inner and outer conductors 120 and 124 to the terminals 106 and 108 respectively is reduced, the portion of the loop pickup area 230 between the conductive output and return signal paths is reduced.

Moreover, the small cross sectional area of the semi-rigid coaxial cable 114 makes the spacing between the inner and outer conductors 120 and 124 small. As a result, the inner conductor 120 of the conductive output signal path and the conductive wire 115 of the conductive return signal path are spaced adjacently to each other as are the terminals 106 and 108. Thus, the portion of the loop pickup area 230 between the conductive output and return signal paths is further reduced.

Since the loop pickup area 230 is reduced in the manner just described, the amount of both circumferential and non-circumferential stray magnetic flux that passes through the loop pickup area 230 is limited. Thus, the pickup loop area mutual inductance 232 and any associated voltage spike induced across the loop pickup area mutual inductance 232 due to a change in magnetic flux through loop pickup area 230 are both reduced. As a result, the output signal overshoot across the output terminals 122 and 128 due to the pickup loop area mutual inductance 232 is also reduced.

Referring back to FIG. 5, all of the inner walls or portions 206 and 208, the outer wall or portion 210, and the side walls or portions 214 and 216 are spaced from the winding assembly 110. In other words, no portion of the transformer shield 104 is adjacent to the winding assembly 110. Moreover, the transformer shield 104 does not enclose another transformer shield that has any portion adjacent to the winding assembly 110.

In the preferred embodiment of transformer 100, the inner walls 206 and 208 are respectively spaced approximately 0.31 inches and 0.25 inches from the core 136 so that transformer 100 has approximately a two inch hole diameter in which the conductor 102 may be placed for monitoring by the transformer 100. Moreover, the outer wall 210 is spaced approximately 0.32 inches from the core 136 and the side walls 214 and 216 are each spaced approximately 0.32 inches from the core 136.

Since all of the transformer shield 104 is spaced apart from the winding assembly 110 and no other shield is enclosed by the transformer shield 104, stray capacitances between the transformer shield 104 and the core 136, the winding 138, the resistive load 140, and the planar conductor 142 are reduced. This flattens the frequency response of the transformer 100 and reduces ringing in the time domain of the output signal of the transformer 100 across the output terminals 122 and 128.

Moreover because all of the transformer shield 104 is spaced apart from the winding assembly 110, the portion of the coaxial cable 114 enclosed by the transformer shield 104 can be disposed between the outer wall 210 of the transformer shield 104 and the resistive load 140, as shown in FIGS. 1 and 3.

Referring again to FIGS. 1, 3, and 5 in order to reduce any remaining output overshoot, the transformer 100 includes the compensation coil 117. Referring to FIG. 4, the compensation coil 117 has a compensating mutual inductance 240 with the conductor 102 that is selected to compensate for, offset, and reduce output overshoot due to the intrinsic inductance (i.e., the combined effect of the section intrinsic inductances 174) of the resistive load 140 and the pickup loop area mutual inductance 232. The mutual inductance 240 of the compensation coil 117 is determined and selected as follows.

First, the transformer 100 is configured so that the conductive output signal path connects the output signal terminal 122 of the transformer 100 and the signal terminal 106 of the winding assembly 110, but does not include the compensation coil 117. Then, output signal overshoot across the output terminals 122 and 128 and the change in the current of the conductor 102 is observed and recorded.

The inductance 240 of the compensation coil 117 is then determined by computing the number of turns and the loop area 242 enclosed by each turn according to the following relationship:

$$(N_c A_c \mu_0 / 2\pi r_c)\ dI/dt = V_c$$

where (a) $V_c$ is the observed output overshoot voltage across the terminals 122 and 128 due to the intrinsic inductance (distributed inductances 174) of the resistive load 140 and the pickup loop area mutual inductance 232 when the compensation coil 117 is not part of the first conductive path 146, (b) $N_c$ is the number ($\geqq 1$) of turns of the compensation coil 117, (c) $A_c$ is the loop area 242 enclosed by each turn, (d) $\mu_0$ is the permeability constant, (e) $r_c$ is the distance from the center of the compensation coil 117 to the conductor 102, (f) dI/dt is the observed change over time in the conductor 102, and (g) $N_c A_c \mu_0 / 2\pi r_c$ defines the mutual inductance of the compensation coil 117. $V_c$ and dI/dt are observed using conventional test equipment such as an oscilloscope.

Finally, the compensation coil 117 is coupled between the end 130 of the inner conductor 120 and the signal terminal 106 of the winding assembly 110 so that it is part of the conductive path 146. Furthermore, referring to FIGS. 3, 5, and 6 the compensation coil 117 is oriented (when coupled as described above) so that the loop area 242 of each of its turns is at least substantially perpendicular to the circumferential magnetic flux 218 (shown in FIG. 6) within the transformer shield 104, as was suggested earlier. This is done so that the polarity of the voltage induced across compensation coil 117 in response to a rapid change in the magnetic flux through it is opposite to the voltage spike induced across the pickup loop area mutual inductance 232 in response to this same change in magnetic flux.

As is evident from the foregoing discussion, the compensation coil 117 has a number of turns Nc, a loop area $A_c$ for each turn, and an orientation selected to reduce output signal overshoot due to the intrinsic inductance (distributed inductances 174) of the resistive load 140 and the pickup loop area mutual inductance 232. As a result, the useable rise time of a pulse output signal across the terminals 122 and 128 of the transformer 100 can be reduced significantly while alternating currents with higher frequencies can also be accurately monitored across terminals 122 and 128.

While the present invention has been described with reference to a few specific embodiments, the description is illustrative of the invention and is not to be construed as limiting the invention. Furthermore, various other modifications may occur to those skilled in the art without departing from the true spirit and scope of the invention as defined by the appended claims.

What is claimed is:

1. A current transformer for monitoring a current in a monitored conductor, said current transformer comprising:

a winding assembly including a first winding assembly terminal, a second winding assembly terminal, a winding coupled between said first and second winding assembly terminals, and a resistive load along said winding and coupled between said first and second winding assembly terminals, said resistive load having a resistance and an intrinsic inductance effectively in series with said resistance;

a first output terminal;

a second output terminal;

a first conductive path connecting said first winding assembly terminal and said first output terminal; and a second conductive path connecting said second winding assembly terminal and said second output terminal;

said winding assembly producing across said first and second output terminals an output signal with a voltage generally proportional to said monitored current in response to a changing magnetic flux that passes through said winding and is caused by changes in said monitored current;

said first and second conductive paths at least partially enclosing a loop pickup area;

a compensation coil in one of said first and second conductive paths and through which said changing magnetic flux passes, said compensation coil having a compensating mutual inductance with said monitored conductor that is selected so as to reduce output signal overshoot across said first and second output terminals caused by said intrinsic inductance in response to said changing magnetic flux and cause by a loop pickup area mutual inductance with said monitored conductor in response to said changing magnetic flux passing through said loop pickup area.

2. A current transformer as recited in claim 1 further comprising a transformer shield enclosing said winding assembly and said compensation coil and shaped to allow penetration of said changing magnetic flux within said transformer shield.

3. A current transformer as recited in claim 2 wherein said compensating mutual inductance is selected by determining the number of turns of said compensation coil and the loop area of each of said turns according to the relationship:

$$(N_c A_c \mu_0 / 2\pi r_c) dI/dt = V_c$$

where (a) $V_c$ is an observed output signal overshoot voltage across said first and second output terminals caused by said intrinsic inductance and said loop pickup area mutual inductance when said compensation coil is not included in said first conductive path and in response to a changing magnetic flux caused by an observed current change over time in an observed conductor, (b) $\mu_0$ is a permeability constant, (c) $r_c$ is the distance from the center of said loop area of each of said turns to said observed conductor, (d) $A_c$ is the loop area of each of said turns, (e) $N_c$ is the number of turns, (f) $N_c A_c \mu_0 / 2\pi r_c$ is said compensating mutual inductance, and (g) dI/dt is said observed current change.

4. A current transformer as recited in claim 3 wherein said compensation coil is disposed in said transformer shield such that the loop area of each of said turns is substantially perpendicular to said changing magnetic flux.

5. A current transformer as recited in claim 4 wherein:

said first and second winding assembly terminals are adjacent to each other;

said current transformer further comprises a small gauge semi-rigid coaxial cable including:

an inner conductor included in said first conductive path and having a first end coupled to said first winding assembly terminal and a second end coupled to said first output terminal;

an outer conductor included in second conductive path and having a first end coupled to said second winding assembly terminal and a second end coupled to said second output terminal; and an insulator between said inner and said outer conductors;

said small gauge semi-rigid coaxial cable has a portion including said first ends of said inner and outer conductors that is enclosed by said transformer shield, said small gauge semi-rigid coaxial cable having a small cross section so that said first ends of said inner and outer conductors are respectively proximate to said first and second ones of said winding assembly terminals and so that spacing between said inner and outer conductors is small whereby said loop pickup area is reduced such that said loop pickup area mutual inductance is reduced and said output signal overshoot caused by said loop pickup area mutual inductance is reduced.

6. A current transformer for monitoring a current in a monitored conductor, said current transformer comprising:

a winding assembly including a first winding assembly terminal, a second winding assembly terminal, a winding coupled between said first and second winding assembly terminals, and a resistive load along said winding and coupled between said first and second winding assembly terminals, said resistive load having a resistance and an intrinsic inductance effectively in series with said resistance;

a first output terminal;

a second output terminal;

a first conductive path connecting said first winding assembly terminal and said first output terminal; and a second conductive path connecting said second winding assembly terminal and said second output terminal;

said winding assembly producing across said first and second output terminals an output signal with a voltage generally proportional to said monitored current in response to a changing magnetic flux that passes through said winding and is caused by changes in said monitored current;

said first and second conductive paths at least partially enclosing a loop pickup area;

a compensation coil in one of said first and second conductive paths and through which said changing magnetic flux passes, said compensation coil having a compensating mutual inductance with said monitored conductor that is selected so as to reduce output signal overshoot across said first and second output terminals that is caused by said intrinsic inductance in response to said changing magnetic flux and caused by a loop pickup area mutual inductance with said monitored conductor in response to said changing magnetic flux passing through said loop pickup area;

a transformer shield enclosing said winding assembly and said compensation coil and shaped to allow penetration of said changing magnetic flux within said transformer shield.

7. A current transformer as recited in claim 6 wherein said compensating mutual inductance is selected by determining the number of turns of said compensation coil and the loop area of each of said turns according to the relationship:

$$(N_c A_c \mu_0 / 2\pi r_c) dI/dt = V_c$$

where (a) $V_c$ is an observed output signal overshoot voltage across said first and second output terminals caused by said intrinsic inductance and said loop pickup area mutual inductance when said compensation coil is not included in said first conductive path and in response to a changing magnetic flux caused by an observed current change over time in an observed conductor, (b) $\mu_0$ is a permeability constant, (c) $r_c$ is the distance from the center of said loop area of each of said turns to said observed conductor, (d) $A_c$ is the loop area of each of said turns, (e) $N_c$ is the number of turns, (f) $N_c A_c \mu_0 / 2\pi r_c$ is said compensating mutual inductance, and (g) dI/dt is said observed current change.

8. A current transformer as recited in claim 7 wherein said compensation coil is disposed in said transformer shield such that the loop area of each of said turns is substantially perpendicular to said changing magnetic flux.

9. A current transformer as recited in claim 6 wherein all of said transformer shield is spaced from said winding assembly and does not enclose another transformer shield such that stray capacitances between said transformer shield and said winding assembly are reduced so as to flatten said transformer's frequency response and reduce ringing in said output signal.

10. A current transformer as recited in claim 9 further comprising:

said first and second winding assembly terminals are adjacent to each other;

said current transformer further comprises a small gauge semi-rigid coaxial cable including:

an inner conductor included in said first conductive path and having a first end coupled to said first winding assembly terminal and a second end coupled to said first output terminal;

an outer conductor included in second conductive path and having a first end coupled to said second winding assembly terminal and a second end coupled to said second output terminal; and an insulator between said inner and said outer conductors;

said small gauge semi-rigid coaxial cable has a portion including said first ends of said inner and outer conductors that is enclosed by said transformer shield, said small gauge semi-rigid coaxial cable having a small cross section so that said first ends of said inner and outer conductors are respectively proximate to said first and second ones of said winding assembly terminals and so that spacing between said inner and outer conductors is small whereby said loop pickup area is reduced such that said loop pickup area mutual inductance is reduced and said output signal overshoot caused by said loop pickup area mutual inductance is reduced.

11. A method of selecting a compensating mutual inductance for a compensation coil in a current transformer, said compensating mutual inductance being mutual with a monitored conductor that is monitored by the current transformer, said current transformer including a first output terminal, a second output terminal, a winding assembly, a first conductive path, and a second conductive path, said winding assembly having a first winding assembly terminal, a second winding assembly terminal, a resistive load, and a winding, said resistive load and said winding each being coupled between said first and second winding assembly terminals, said resistive load being disposed along said winding and having a resistance and an intrinsic inductance effectively in series with said resistance, said winding assembly producing an output signal across said output terminals with a voltage generally proportional to said monitored current in response to a changing magnetic flux resulting from changes in said monitored current, said intrinsic inductance causing output signal overshoot across said first and second output terminals in response to said changing magnetic flux, said first and second conductive paths at least partially enclosing a pickup loop area through which said changing magnetic flux passes so as to provide an associated loop pickup area mutual inductance with said monitored conductor that also causes output signal overshoot across said first and second output terminals, said compensation coil being included in one of said first and second conductive paths so that said compensating mutual inductance reduces output signal overshoot across said first and second output terminals caused by said intrinsic inductance and said loop pickup area mutual inductance said method comprising the steps of:

observing a current change in conductor when said compensation coil is not included in said first conductive path;

observing an output signal overshoot voltage across said first and second output terminals due to said intrinsic inductance and said loop pickup area mutual inductance and in response to a changing magnetic flux caused by said observed current change; and selecting said compensating mutual inductance based on said observed current change and said observed output signal overshoot.

12. A method as recited in claim 11 wherein said selecting step includes the step of determining the number of turns of said compensation coil and the loop area of each of said turns according to the relationship:

$$(N_c A_c \mu_0 / 2\pi r_c) dI/dt = V_c$$

where (a) $V_c$ is said observed output signal overshoot voltage, (b) $\mu_0$ is a permeability constant, (c) $r_c$ is the distance from the center of said loop area of each of said turns to said observed conductor, (d) $A_c$ is the loop area of each of said turns, (e) $N_c$ is the number of turns, (f) $N_c A_c \mu_0 / 2\pi r_c$ is said compensating mutual inductance, and (g) dl/dt is said observed current change.

* * * * *